US005831524A

United States Patent [19]

Tice et al.

[11] Patent Number: 5,831,524

[45] Date of Patent: Nov. 3, 1998

[54] SYSTEM AND METHOD FOR DYNAMIC ADJUSTMENT OF FILTERING IN AN ALARM SYSTEM

[75] Inventors: Lee D. Tice, Bartlett, Ill.; Donald D. Anderson, Easton, Conn.

[73] Assignee: Pittway Corporation, Chicago, Ill.

[21] Appl. No.: 840,393

[22] Filed: Apr. 29, 1997

[51] Int. Cl.[6] ..... G08B 29/00

[52] U.S. Cl. ..... 340/506; 340/511; 340/514; 340/588; 364/557; 364/572

[58] Field of Search ..... 340/506, 514, 340/511, 510, 588, 589, 870.17; 364/550, 551.01, 557, 572, 138, 139, 141

[56] References Cited

U.S. PATENT DOCUMENTS

| | | | |
|---|---|---|---|
| 5,218,440 | 6/1993 | Mathur | 358/213 |
| 5,227,972 | 7/1993 | Jacobson | 364/422 |
| 5,282,261 | 1/1994 | Skeirik | 395/22 |
| 5,612,674 | 3/1997 | Tice | 340/517 |

FOREIGN PATENT DOCUMENTS

| | | |
|---|---|---|
| 0 180 085 A2 | 10/1985 | European Pat. Off. . |
| 0 274 042 A2 | 11/1987 | European Pat. Off. . |
| 0 517 097 A2 | 5/1992 | European Pat. Off. . |

*Primary Examiner*—Donnie L. Crosland

*Attorney, Agent, or Firm*—Rockey, Milnamow & Katz, Ltd.

[57] ABSTRACT

A system and a method for dynamically adjusting a level of filtering or smoothing applied to data received from fire detectors produces shortened response times for detection of a fire condition while at the same time minimizing the effects of uncorrelated noise in the absence of any fire condition. An increasing probability of a fire results in less filtering. Increasing values of the input signal from a respective detector, indicative of an increasing selected ambient condition such as combustion or temperature, provide a control input for reducing or bypassing the level of filtering of the respective input signal thereby reducing system response time. Where the unfiltered input data from a respective detector indicates a combustion or temperature profile moving toward clear air, the filtering or smoothing level can also be dynamically decreased thereby enabling the filtered signal values to return to their respective clear air values faster than would otherwise be the case. Detectors can be grouped and multiple unfiltered outputs can be assessed substantially simultaneously to determine whether or not levels of filtering or smoothing for the members of the group should be dynamically decreased.

38 Claims, 4 Drawing Sheets

SYSTEM AND METHOD FOR DYNAMIC ADJUSTMENT OF FILTERING IN AN ALARM SYSTEM

FIELD OF THE INVENTION

The invention pertains to systems for determining the presence of a pre-selected ambient condition. More particularly, the invention pertains to such systems which incorporate filtering to minimize uncorrelated noise wherein a degree of filtering is dynamically adjusting in response to detected conditions.

BACKGROUND OF THE INVENTION

Distributed fire alarm systems which incorporate a plurality of ambient condition detectors, such as smoke, heat or gas detectors, are often installed in business or commercial buildings. Such systems often have a common control unit which can be in either unidirectional or bidirectional communication with multiple, spatially separated, ambient condition detectors.

One of the problems associated with transmission of information to or from such detectors is the presence of uncorrelated noise. Noise is uncorrelated wherein it is not related to a selected parameter or parameters which is/are being monitored.

In the event that the parameter being monitored is a level of ambient smoke, an ambient temperature, or a level of an ambient gas, the signals of interest are those which have a high correlation to the particular ambient condition being detected. Other signals, due to electrical or thermal noise which are not correlated to the ambient condition being detected, and which may in fact be random, are undesirable. Various techniques have been used in the past to minimize the effects of such uncorrelated noise signals.

One known type processing or filtering involves sampling the signals from at least one of the ambient condition detectors and calculating a running average based on a predetermined number of prior sample values, such as 6 or 8 or 10, along with the latest sample value. As each new sample value is received, the running average is updated. This technique provides a vehicle for minimizing or suppressing the effects of uncorrelated noise. This process can also be carried out continuously using analog circuits.

Filters can be implemented using analog or digital hardware. Alternately, they can be implemented digitally in software. One such system is described in U.S. Pat. No. 5,612,674 entitled High Sensitivity Apparatus and Method With Dynamic Adjustment for Noise assigned to the Assignee hereof and incorporated by reference herein.

While known approaches do provide a vehicle for suppressing or reducing uncorrelated noise in signals from ambient condition detectors, they also introduce delays. In the event that the parameter of interest, such as level of smoke or ambient temperature, does start to increase, the increases are attenuated and only appear in the output filtered signals after a delay interval which is characteristic of the type of averaging or filtering which is used.

From the point of view of providing an even faster response to a developing fire condition, it would be desirable to use one or more filtering techniques for purposes of removing uncorrelated noise signals from the signal of interest, without attenuating or delaying detection of a significant increase in the parameter of interest.

SUMMARY OF THE INVENTION

A system and a method of dynamic adjusting of filtering respond to the presence of a predetermined profile. Where the profile corresponds to the presence of fire or combustion, in accordance with the present system and method, a level of filtering or smoothing can be altered consistent with the expected probability of the presence of a fire or combustion. As the probability of a fire increases, the smoothing levels can be reduced or eliminated. Alternately, as the probability of a fire drops, the smoothing level can be reduced to shorten system response time when returning to a normal clear air state.

Where a first level of filtering has been selected and a characteristic feature associated with the input data from a selected detector, moves in a direction associated, for that type of detector, with an increased probability of fire or combustion, the level of filtering or smoothing can be immediately and automatically reduced a predetermined amount so as to shorten system response time. Hence, under normal clear air operating conditions where a signal being received from a selected detector is indicative of clear air with a noise component superimposed thereon, a relatively high level of filtering or smoothing can be implemented to as to minimize or eliminate the superimposed random noise component thereby producing a filtered or smoothed output signal which responds slowly and with some delay. On the other hand, where the unsmoothed signals from the detector start to indicate the presence of fire or combustion, rather than waiting for the filtered signal to increase, the level of filtering or smoothing can be immediately decreased, thereby enabling the filtered signal to increase at a faster rate than would have been possible with the initial level of filtering or smoothing.

In one aspect, a plurality of unfiltered or unsmoothed data values from a given detector, which values are normally filtered or smoothed to a first level, are examined. For example, if 2 or 3 or 4 unfiltered values in a row from a given detector increase, beyond a selected threshold value, the level of filtering or smoothing for that detector could be reduced so as to make available in a shorter period of time, increasing, though still filtered, values from the subject detector for analysis purposes. In another aspect, in the event that the unfiltered data from the respective detector falls over several consecutive samples toward a clear air value, the level of filtering or smoothing could be decreased, thereby decreasing the response time of the system to return to a normal clear air state. Once the filtered value has returned to a corresponding clear air representation, the level of smoothing can again be increased.

In yet another aspect, detectors can be grouped and outputs from a group of detectors can be used to dynamically alter smoothing levels for that group of detectors. For example, if 2 or 3 or 4 increases in a row from two different detectors in a group are noted, the level of filtering or smoothing for all of the detectors in the group could be immediately reduced. Hence, as outputs from multiple detectors increase, an immediate reduction in the level of filtering or smoothing can be achieved. This will produce an immediate shortened response time in the presence of a fire or combustion profile. Advantageously however, in the absence of an increasing fire or combustion profile, the original higher levels of filtering or smoothing will remain in effect thereby continuing to dampen out uncorrelated noise which at times leads to false alarms.

In yet another aspect, instead of merely reducing a level of filtering or smoothing, in the event that one or more of the detectors indicates the presence of a rapidly increasing profile, most or all of the filtering or smoothing can be bypassed thereby providing a very short response time to a rapidly increasing fire or combustion condition.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
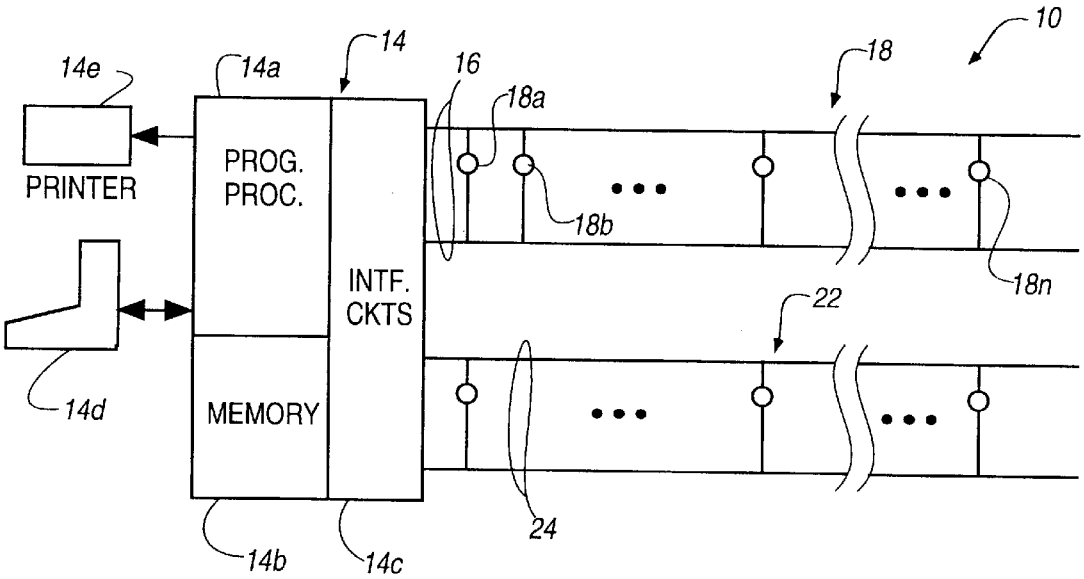
FIG. 1 is a block diagram of an alarm system which embodies variable levels of filtering or smoothing.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates an alarm system 10 which incorporates a common control unit 14. The system 10 could, for example, be part of a more extensive building control system. It could also include a plurality of linked control units 14.

The control unit 14 can further include a programmable processor 14*a,* associated memory 14*b* and interface circuitry 14*c*. The interface circuitry couples the processor 14*a,* via a communication link 16 to a plurality of ambient condition detectors 18. The link can be unidirectional or bidirectional.

The members of the plurality 18, 18*a,* 18*b* . . . 18*n* each include one or more ambient condition sensors such as smoke sensors, flame sensors, gas sensors or heat sensors. The members of the plurality 18 communicate to the processor 14*a,* via the communications link 16 signals, indicative of the sensed ambient condition. The signals can be in analog or digital form without limitation.

Processor 14*a,* in response to processing modules and instructions stored in memory 14*b* processes the returned ambient condition signals or indicators from one or more of the detectors in the plurality 18. In the presence of a predetermined alarm condition, a plurality of audible and/or visual alarm output devices 22 can be energized, via communication link 24, to thereby provide both visual and audible indicators of an alarm condition in the region being monitored.

An operator's counsel 14*d* can be used to provide a visual indication to an operator of an alarm condition. Alternately, alarm or related conditions can be logged in a printer 14*e*.

The indicators from the detectors 18 can be filtered or smoothed to minimize the effects of uncorrelated noise. The degree of smoothing can be varied in response to the probability of a fire being present.

In the presence of random variations in the indicators being received from the members of the plurality 18, characteristic of uncorrelated noise, a high level of filtering or smoothing can be implemented. This in turn limits the response time of the system.

Filtering or smoothing can be implemented in the control unit 14. Alternately, it can be implemented in one or more distributed devices including smoke detectors, fire detectors, gas detectors or the like without limitation.

If on the other hand the indicators from the detectors 18 correspond to a fire profile, then the processor 14*a* can respond by either reducing or bypassing the level of smoothing or filtering thereby providing faster system response time.

As described below, the filtering or smoothing process can be carried out in hard-wired circuitry. Alternately, the process can be carried out by the execution of pre-stored instructions in the form of a control program stored in the memory 14*b*. The processor 14*a* can then execute the prestored instructions to implement single or multiple stage exponential-like filtering or smoothing functions as well as to carry out software based alarm processing. If desired, the raw signals or indicators from the detectors can be pre-filtered or pre-processed in accordance with the system described in U.S. patent application Ser. No. 08/522,599 filed Sep. 1, 1995, entitled "Pre-Processor Apparatus And Method," assigned to the assignee hereof and incorporated by reference herein.

Figure 2:
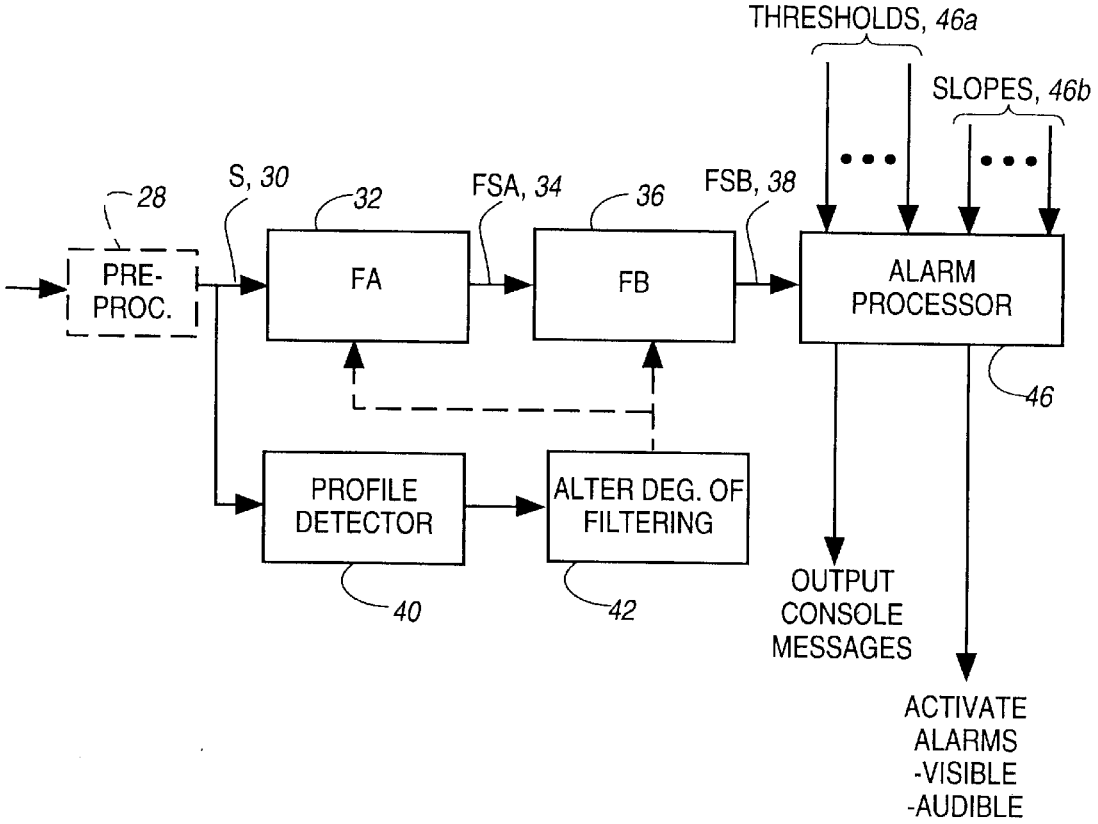
FIG. 2 is a block diagram illustrating an apparatus and a process for automatically altering a level of filtering or smoothing in response to the presence of a predetermined profile.

FIG. 2 illustrates an exemplary block diagram of the present process and apparatus. It will be understood that the block diagram of FIG. 2 could be implemented in either hard-wired form or via the control program stored in the memory 14*b* which is in turn executed by the processor 14*a*.

An output S' from one of the detectors, for example detector 18*a* can optionally first be pre-processed in an element 28 (indicated in phantom in FIG. 2). The output S from the pre-processor 28 on the raw input signal on a line 30, is filtered or smoothed in a first filter 32. The output of the first filter 32 is a filtered signal FSA on line 34. The signal on the line 34 is in turn filtered or smoothed a second time in filter 36 thereby producing a second filtered output FSB on a line 38.

In addition to providing an input to the first filter 32, the line 30 couples the indicators from the detector 18*a* to a profile detector 40. The profile detector determines if the signal or indicator on the line 30 is exhibiting a profile associated with a fire condition. If a fire is probable, then the element 40 can either reduce the degree of filtering or smoothing exhibited by one or both of the filters 32, 36 or can bypass one or both of the filters 36 in a process step 42. Exemplary profiles include increasing signal amplitudes or increasing signal slopes. Profiles can also be recognized using fuzzy logic type processing or neural nets.

The output of the filter 36, on the line 38 is in turn coupled to alarm processing circuitry or software 46. Inputs to the alarm processor 46 can include a plurality of thresholds 46*a* as well as or along with a plurality of slopes 46*b*.

The characteristics of the filtered signal on the line 38 can in turn be compared to one or more of the thresholds 46*a* and/or one or more the slopes 46*b* by the alarm processor. Alternately, more complex pattern recognition methods can be used.

In the event that an alarm condition is detected, a message can be displayed on the console 14*d*. Alternately, the alarm condition can be logged on the printer 14*e*. Further, the audible and visible alarm indicators 22 can be energized thereby alerting individuals in the region being supervised to the presence of the alarm condition.

It will be understood that neither the characteristics of the filters 32, 36 nor the implementation thereof are limitations of the present invention. It will also be understood that a fire profile could appear on a transient basis, in which the level of smoothing would be reduced or bypassed thereby decreasing the response time of the system 10. However, if the detected profile fades away or disappears, as would be the case of a transient smoke level for example, the level of filtering or smoothing could again be increased restoring the system 10 to its normal quiescent operating condition.

Alternately, in the event that the signal on the line 30 is determined by profile detector 40 to be returning to a clear air level, indicative of the absence of a fire condition, the level of filtering or smoothing, for example in the filters 32, 36 can be reduced or bypassed so as to enable the processed output signal on the line 38 to return to the corresponding filtered clear air value sooner than would otherwise be the case. In this instance, once the filtered signals return to their respective clear air values, the level of filtering can again be increased.

Figure 3:
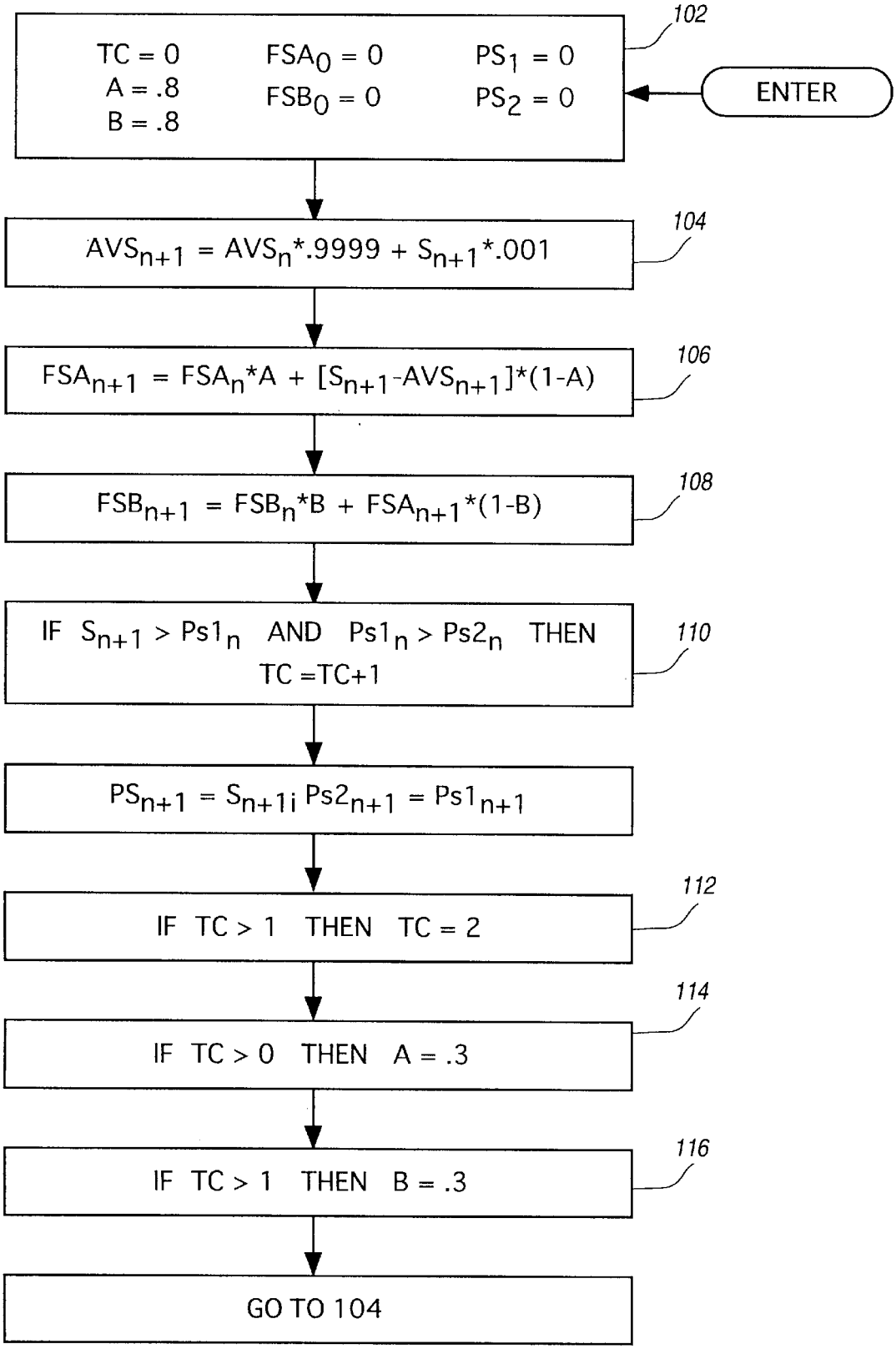
FIG. 3 is a flow diagram illustrating a method of varying smoothing or filtering which can be implemented using the system of FIG. 1.

FIG. 3 illustrates in more detail the steps of a method 100 implementable by the block diagram of FIG. 2. In an initialization step 102 variables are set equal zero. Filter constants A, B for filters 32, 36 are initialized.

In a subsequent step 104, a long term running average value of the signal on the line 30, from the respective detector is formed. The signal on the line 30 can be filtered or smoothed, for example in a step 106 in the first filter 32 (implemented in software in exponential-like processing). As indicated, in this step, the incoming signal from the respective detector is normalized by subtracting from it the value of the long term running average associated with that detector. The long term running average associated with the detector should correspond to a clear air output value. With this level of filtering, only 20% of the new value of $S_{n+1}$, for the respective detector is added to 80% of the prior filtered output value.

The output of the first filter stage 32 is in turn fed into the second stage 36 and processed in a step 108. The output of the second stage 36, on the line 38, can in turn be processed in the alarm processor 46 as discussed above.

Various types of profile detection can be implemented. For example, if the present value from the respective detector exceeds the previous value $P_{S1}$ and if the previous value exceeds the second previous value $P_{S2}$, an indication is present that there have been two increases in the last three values received from that detector. Such increases are often indicators that a fire is probable in that a level of smoke, flame, or temperature is steadily increasing.

In response to the increasing level of the signal on the line 30, the variable TC can be incremented in a step 110. Subsequently, if the variable TC exceeds one, step 112, then it can be set to the value of two. Subsequently, in a step 114 if TC is greater than zero, than the constant A can be reduced from, for example, an initial value on the order of 0.8 to a lower value, for example, 0.3. This will reduce the level of filtering or smoothing in the first stage 32.

Figure 4:
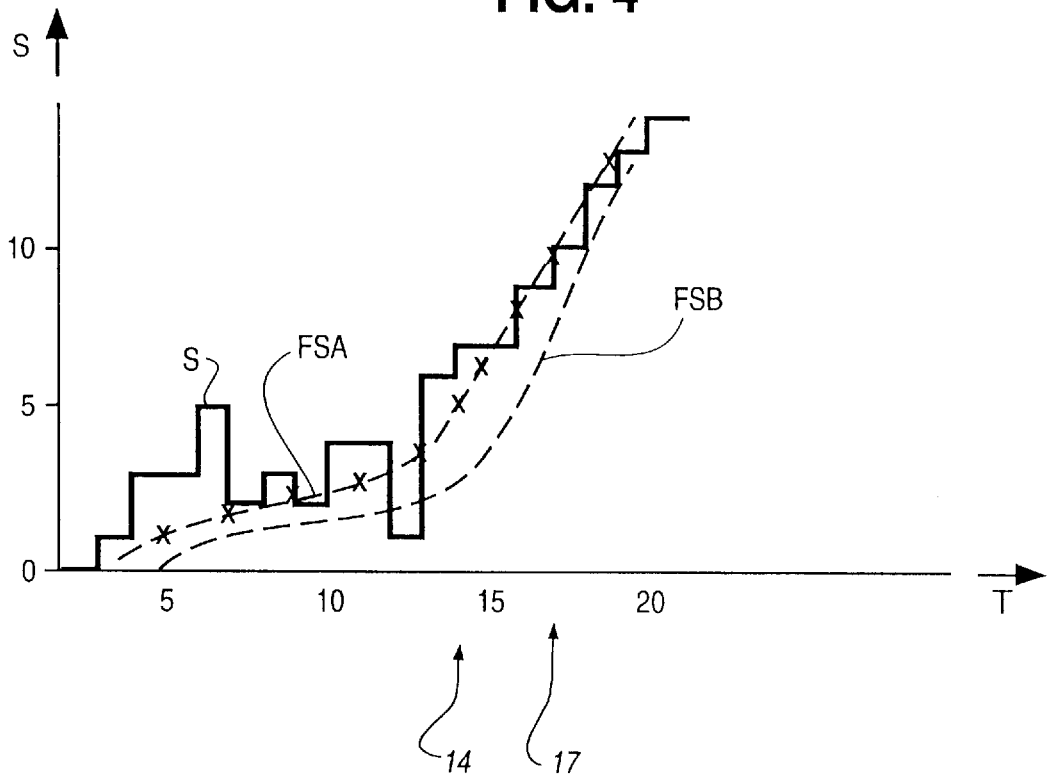
FIG. 4 is a graph illustrating performance characteristics of the method of FIG. 3.

If subsequently in a step 116 the variable TC exceeds the value of one, then the level of filtering in the stage 36 can be reduced by reducing the constant B from an initial value of 0.8 to a value of 0.3. FIG. 4 is an illustration of the results plotted vs. time of processing the signals on the line 30 in accordance with the method of FIG. 3. Table 1 indicates the corresponding values for the respective time intervals. As both FIG. 4 and Table 1 illustrate, at T=14 and T=17 constants A, B changed in response to the presence of a detected fire profile. Hence, the level of smoothing was reduced at those times. This in turn shortened the response time of the output of the filter 36 thereby making faster detection possible in processor 46. Other profiles can be used.

For example, the slope of the incoming signals or indicators could be used instead of the amplitude. To further shorten response time, at T=14 when the constant for filter 32 was altered, instead of continuing processing using filter 36, filter 36 could have been completely bypassed. In this instance, the output on line 34 would then have been fed directly into processor 46.

TABLE 1

| S | T | AVs | FSA | FSB | PS1 | PS2 | TC | A | B |
|---|---|---|---|---|---|---|---|---|---|
| 0 | 0 | 0 | 0 | 0 | 0 | 0 | 0 | .8 | .8 |
| 0 | 1 | 0 | 0 | 0 | 0 | 0 | 0 | .8 | .8 |
| 0 | 2 | 0 | 0 | 0 | 0 | 0 | 0 | .8 | .8 |
| 1 | 3 | .0001 | .1999 | .039 | 0 | 0 | 0 | .8 | .8 |
| 3 | 4 | .0004 | .7598 | .1597 | 1 | 0 | 0 | .8 | .8 |
| 3 | 5 | .0007 | 1.2076 | .3692 | 3 | 1 | 0 | .8 | .8 |
| 5 | 6 | .0012 | 1.9657 | .6884 | 3 | 3 | 0 | .8 | .8 |
| 2 | 7 | .0014 | 1.9722 | .9451 | 5 | 3 | 0 | .8 | .8 |
| 3 | 8 | .0017 | 2.1773 | 1.1914 | 2 | 5 | 0 | .8 | .8 |
| 2 | 9 | .0019 | 2.1414 | 1.3813 | 3 | 2 | 0 | .8 | .8 |
| 4 | 10 | .0023 | 2.5126 | 1.6075 | 3 | 3 | 0 | .8 | .8 |
| 4 | 11 | .0027 | 2.8094 | 1.8478 | 4 | 2 | 0 | .8 | .8 |
| 1 | 12 | .0027 | 2.4469 | 1.9675 | 4 | 4 | 0 | .8 | .8 |
| 6 | 13 | .0033 | 3.1568 | 2.2053 | 1 | 4 | 0 | .8 | .8 |
| 7 | 14 | .004 | 5.8447 | 2.9330 | 6 | 1 | 1 | .3 | .8 |
| 7 | 15 | .0047 | 6.6499 | 3.6763 | 7 | 6 | 1 | .3 | .8 |
| 9 | 16 | .0056 | 8.2909 | 4.5991 | 7 | 7 | 1 | .3 | .8 |
| 10 | 17 | .0066 | 9.4825 | 8.0174 | 9 | 7 | 2 | .3 | .3 |
| 12 | 18 | .0078 | 11.2392 | 10.2726 | 10 | 9 | 2 | .3 | .3 |
| 13 | 19 | .0103 | 12.4644 | 11.8067 | 12 | 10 | 2 | .3 | .3 |
| 14 | 20 | | | | 13 | 12 | 2 | .3 | .3 |
| 15 | 21 | | | | 14 | 13 | 2 | .3 | .3 |

As noted above, in the event that the profile detection element 40 determines that the signal on the line 30 is decreasing toward its long term clear air value, the level of filtering of the stages 32, 36 could also be reduced thereby shortening the time interval for the processed or filtered signal on the line 38 to return to a corresponding clear air value as well. Subsequently, the level of filtering in the stages 32, 36, can be restored to its normal quiescent value to reduce the probability of false alarms being generated due to uncorrelated noise.

Figure 5A:
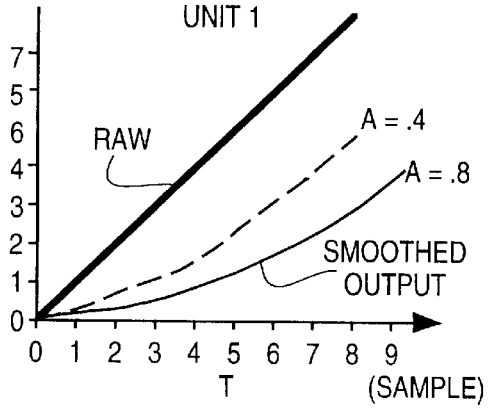
FIGS. 5A and 5B illustrate outputs from two different detectors as a function of different levels of smoothing.
Figure 5B:
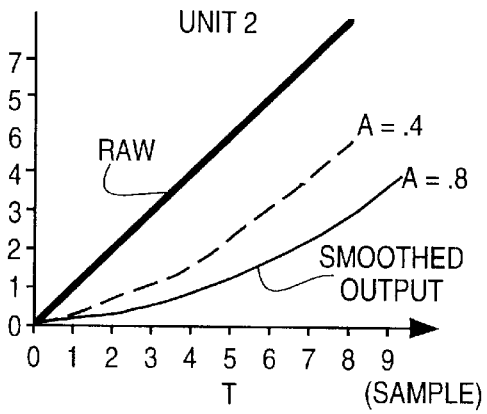
Figure 6:
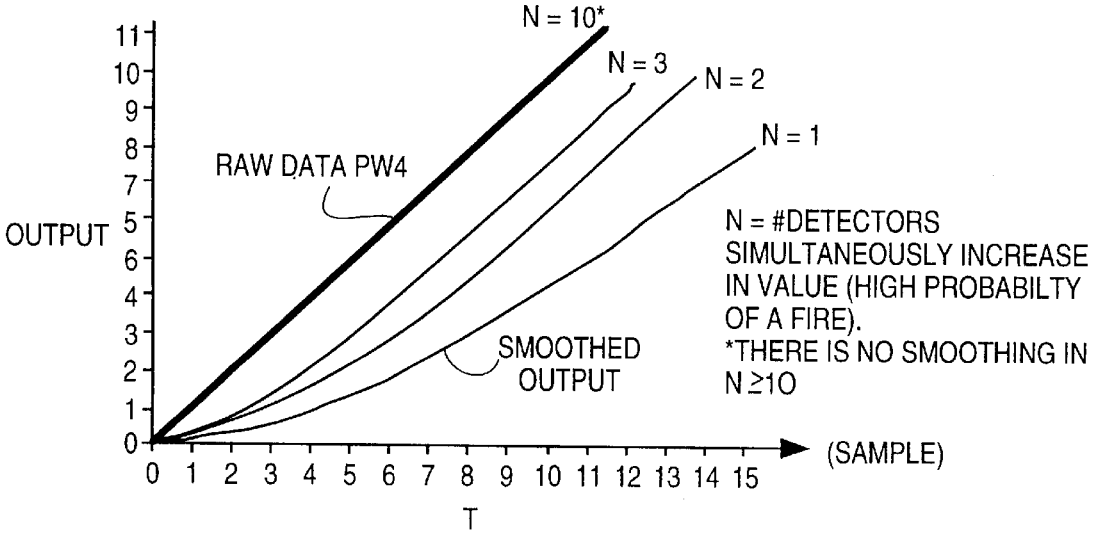
FIG. 6 is a graph illustrating different levels of smoothing based upon the number of detectors which exhibit a profile indicative of a high probability of fire.

FIGS. 5A, 5B, and FIG. 6 illustrate various aspects of extending the above-described system and method to multiple detectors. For example, if a smoke or fire indicating output of more than one detector in a subregion of a larger region being supervised is increasing, this too is indicative of a fire profile. In this case, the degree of smoothing can be reduced proportionately, for example, to the number of detectors in the subregion which are exhibiting an increasing output indicative of increasing smoke, flame, temperature, or gas concentration.

This takes into account, for example, the fact that smoke can propagate into several detectors in a group at the same time. Hence, even small increases in the output signals from the detectors in the group, if simultaneous, provide an indication that the probability of fire has increased.

FIGS. 5A and 5B illustrate representative outputs from two different detectors, which could be located in the same subregion, to ambient levels of smoke. As indicated in FIGS. 5A and 5B, smoothing coefficients can be reduced for each of the detectors individually, as described above, in view of a detected fire profile which is indicative of an increasing probability of a fire. Alternately, the fact that both of the detectors in the subregion are increasing simultaneously can be taken into account to adjust alteration of the smoothing coefficients irrespective of whether a one stage or two stage-type filtering is being used. For example, the filter coefficient "A" can be adjusted so that it changes inversely with the number of detectors in a subregion which are simultaneously exhibiting a fire profile. In this regard, the coefficients can be adjusted as follows:

$$A_{n+1} = \frac{A_n}{N}$$

In accordance with the above formulation, the value of the filtering or smoothing coefficient A is reduced as the number of detectors which are in the subregion and which are exhibiting a selected fire profile increases. Hence, if two detectors, as in FIGS. 5A and 5B are simultaneously increasing, the coefficient value can be reduced by 50%. The coefficient "B" for filter 36 can also be reduced similarly. Alternately, the filter 36 can be bypassed when processing the signals from the affected group.

FIG. 6 illustrates the alteration in smoothing levels for a given detector as the number of detectors in the subregion which are simultaneously exhibiting a fire profile increases. Where the number of detectors which are exhibiting a fire profile equals or exceeds 10, all filtering is bypassed.

As noted above, a variety of different profiles can be used in determining how many detectors are exhibiting a selected profile. For example, a plurality of increasing values over a predetermined period of time indicative of increasing smoke, flame, or temperature can be used. Alternately, the slope of the signals received from the detectors can be compared to a predetermined value as an alternate profile. Yet another profile can be based on the absolute value of the signal received from each of a group of detectors. For example, where signals from detectors in a subregion all exceed a predetermined threshold value, the level of smoothing could be significantly reduced or the smoothing process could be completely bypassed thereby shortening system response time.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A method of processing a signal from an ambient condition detector wherein a selected profile, when present, is indicative of the presence of a predetermined condition; the method comprising:

smoothing the signal to a selected degree, so as to minimize noise not correlated with the profile, thereby producing a smoothed signal; and detecting in the signal the presence of the selected profile, and, in response thereto decreasing the degree of smoothing.

2. A method as in claim 1 wherein execution of the decreasing step is in response to detecting an increasing profile.

3. A method as in claim 2 wherein the selected profile is indicative of the presence of a fire.

4. A method as in claim 1 wherein execution of the decreasing step is in response to detecting a parameter indicative of a decreasing profile.

5. A method as in claim 1 wherein execution of the decreasing step is in response to detecting a non-fire condition.

6. A method as in claim 5 wherein the non-fire condition corresponds to the signal exhibiting a value characteristic of clear air.

7. A method as in claim 6 including determining if the smoothed signal is exhibiting a value characteristic of clear air, and in response thereto increasing the degree of smoothing a predetermined amount.

8. A method as in claim 1 which includes substantially bypassing the smoothing step in response to detecting a selected parameter of the profile.

9. A method as in claim 1 wherein the smoothed signal is processed to determine if the predetermined condition is present.

10. A method as in claim 1 wherein at least the smoothing step is carried out at the respective detector.

11. A method as in claim 1 which includes, prior to the smoothing step, transmitting a representation of the signal from the detector to a displaced processor.

12. A method of processing a signal from an ambient condition sensor wherein a selected signal profile, when present, is indicative of the potential presence of a fire, the method comprising:

filtering the signal to a selected degree so as to minimize noise not correlated with the profile, thereby producing a filtered signal; and detecting in the signal the presence of at least one parameter potentially indicative of the presence of a fire and in response to a detected presence, altering the degree of filtering a predetermined amount; and processing the filtered signal to detect the presence of an alarm condition.

13. A method as in claim 12 wherein in response to a detected increasing presence, the degree of filtering is decreased a predetermined amount.

14. A method as in claim 12 wherein the filtering step includes averaging over a selected number of samples of the signal.

15. A method as in claim 13 wherein in response to a detected decreasing presence, the degree of filtering is increased.

16. A method as in claim 12 wherein in response to a selected increase in a magnitude value of the signal the filtering step is bypassed.

17. A method as in claim 12 wherein in response to a selected increase in a value of the slope of the signal the filtering step is bypassed.

18. A method as in claim 12 wherein the filtering step includes digitally processing the signal to implement a filtering process.

19. A method as in claim 12 wherein the detecting step includes comparing a plurality of signal values to a predetermined threshold and reducing the degree of filtering in response to a selected number of values exceeding that threshold.

20. A method as in claim 12 wherein in the detecting step, in response to the signal returning toward a clear air value, the degree of filtering is reduced a predetermined amount.

21. A method as in claim 20 wherein in the detecting step, in response to the filtered signal substantially returning to a corresponding clear air value, increasing the smoothing a predetermined degree.

22. A method of processing signals from a plurality of ambient condition detectors wherein the signals are each indicative of an ambient condition in the vicinity of a respective detector, the method comprising:

filtering each of the signals from the detectors in a selected group, which includes at least two detectors, thereby producing a plurality of filtered signals; and determining for each signal if a predetermined profile is present, and, in response to a detected profile, reducing a degree of filtering associated with at least some members of the group.

23. A method as in claim 22 wherein the degree to which filtering is reduced is affected by the number of detectors in the group which are exhibiting the profile.

24. A method as in claim 22 which includes:

determining for each signal if a predetermined parameter is decreasing, and in response to a detected decreasing parameter, decreasing a degree of filtering associated with at least some members of the group.

25. A method as in claim 22 wherein the filtering step for at least the detectors in the group includes carrying out a filtering process using a prior filtered value for the respective detector, a current signal value for the respective detector, and a parameter indicative of the number of detectors in the group which are exhibiting the increasing parameter.

26. A method as in claim 25 wherein the filtering step is bypassed, for at least some of the detectors in the group, in response to at least one signal from a detector in the group exhibiting a parameter which exceeds a predetermined value.

27. An ambient condition detecting system comprising:

a control unit;

a communications link coupled to the control unit;

a plurality of ambient condition detectors coupled to the link wherein the detectors provide electrical signals, indicative of adjacent ambient conditions, to the control unit via the link, wherein the control unit includes circuitry for filtering to a selected degree at least one of the electrical signals, to reduce uncorrelated noise thereby producing a respective filtered signal, and wherein the control unit includes further circuitry to detect the presence of a predetermined profile in the one signal, and in response thereto, to dynamically alter the degree of filtering.

28. A system as in claim 27 wherein the control unit includes further circuitry for determining if the profile is changing in a way indicative of an increasing ambient condition and in response thereto reducing the degree of filtering.

29. A system as in claim 27 wherein the control unit includes further circuitry for determining if the profile is changing in a way indicative of a decreasing ambient condition and in response thereto decreasing the degree of filtering, and including further circuitry for subsequently increasing the degree of filtering.

30. A system as in claim 27 wherein the control unit includes circuitry for processing the respective filtered signal to determine if a predetermined condition is present.

31. A system as in claim 27 wherein the control unit includes circuitry for filtering to a respective selected degree a plurality of electrical signals thereby producing a plurality of respective filtered signals and wherein the control unit includes further circuitry to detect the presence of a predetermined profile in at least some of the signals, and in response thereto, dynamically altering the degree of filtering.

32. A system as in claim 31 wherein the control unit includes further circuitry to process at least some of the filtered signals to determine the presence of a selected ambient condition in the vicinity of at least some of the detectors.

33. A system as in claim 31 wherein the control unit includes circuitry for bypassing the filtering circuitry in response at least one of the signals exhibiting a selected condition.

34. A system as in claim 27 wherein the control unit includes a programmed processor and a storage unit which includes a plurality of instructions for carrying out a filtering process.

35. A system as in claim 34 wherein the instructions include further instructions for carrying out at least one exponential-like filtering process.

36. A system as in claim 35 wherein the exponential-like filtering process includes at least one filtering parameter and wherein the altering circuitry includes at least one different pre-stored filtering parameter.

37. An ambient condition detecting system comprising:

at least one ambient condition sensor;

a processor for receiving an electrical signal from the sensor wherein the processor includes circuitry for filtering the signal to a selected degree and circuitry for determining if the signal exhibits a predetermined profile, and in response thereto reducing the degree of filtering.

38. A system as in claim 37 wherein the sensor is carried in a housing and the processor is displaced from the housing.

* * * * *